United States Patent [19]

Whidden

[11] Patent Number: 4,790,109

[45] Date of Patent: Dec. 13, 1988

[54] PROTECTIVE STRUCTURE

[76] Inventor: Agnes Whidden, Rte. 2, Box 13, Moorehaven, Fla. 33471

[21] Appl. No.: 1,577

[22] Filed: Jan. 8, 1987

[51] Int. Cl.[4] ..... E04B 1/32; E04H 6/00

[52] U.S. Cl. ..... 52/79.4; 52/88; 52/157; 52/537

[58] Field of Search ..... 52/88, 82, 80, 529, 52/537, 79.4, 157, 23

[56] References Cited

U.S. PATENT DOCUMENTS

| | | | |
|---|---|---|---|
| 1,093,898 | 4/1914 | Virtue | 52/82 |
| 1,137,689 | 4/1915 | Allsteadt | 52/82 |
| 1,977,391 | 10/1934 | Kramer | 52/82 |
| 2,595,794 | 5/1952 | Keller | 52/80 |
| 3,118,186 | 1/1964 | Moss | 52/80 |
| 3,154,888 | 11/1964 | Graham | 52/79.4 |
| 3,316,682 | 5/1967 | Natalis | 52/82 |
| 3,513,248 | 5/1970 | Bright et al. | 52/80 |
| 3,562,975 | 2/1971 | Moss | 52/80 |
| 3,583,112 | 6/1971 | Kennedy | 52/82 |
| 3,763,608 | 10/1973 | Chamlee | 52/80 |
| 3,924,363 | 12/1975 | Candle | 52/80 |
| 3,924,367 | 12/1975 | Stewart | 52/80 |
| 4,023,317 | 5/1977 | Bettger et al. | 52/80 |
| 4,068,421 | 1/1978 | Marovich | 52/80 |
| 4,192,107 | 3/1980 | Wickstrom et al. | 52/82 |
| 4,453,351 | 6/1984 | Moore | 52/82 |
| 4,550,533 | 11/1985 | Fraioli | 52/80 |

*Primary Examiner*—Michael Safavi

*Attorney, Agent, or Firm*—Gifford, Groh, Sheridan, Sprinkle and Dolgorukov

[57] ABSTRACT

A protective structure comprises a plurality of individual sections each one of which coacts with adjacent sections on both sides that are arranged seriatim to form an elongate unit. A closure at one end is removable affording access and egress from the structure and a closure at the other end is fixed in position. The individual sections are made, preferably, of FIBERGLAS that are spray-coated on the inside with a plastic.

7 Claims, 2 Drawing Sheets

11
13
13a
15
17
25
27
29
51
53
55
57
59
61
63
65
67
69
71
73
III
IV
IVa
V 13
13a
19
21
23
25
27
29
31
33
35
37
39
41
43
45
47
49
75
77

PROTECTIVE STRUCTURE

BACKGROUND OF THE INVENTION

1. Field

The present invention relates generally to protective structures and, more particularly, to an all-weather protective structure such as a boat shed, for a small boat and trailer, and other marine equipment including a motor for such boat, and including a protective structure for other valuable property.

2. Prior Art

U.S. Pat. No. 3,449,874 to Beaupre discloses a house structure including an anchorage assembly for supporting and strengthening building structures during extreme conditions of weather.

SUMMARY OF THE INVENTION

The present invention accomplishes its objects and purposes by providing a sectionalized protective structure that can be easily and quickly assembled and disassembled and transported from place to place affording, in particular, protection and security for a small boat and motor, trailer and other marine equipment. In some instances such a structure may afford protection to workmen performing work in bad weather and as a protective structure for equipment other than marine equipment.

The many objects and advantages of the present invention will become apparent to those skilled in the art when the following description of the best modes contemplated at present for practicing the invention are read in conjunction with the accompanying drawing, wherein like reference numerals refer to like or equivalent parts.

DETAILED DESCRIPTION

Figures 1, 2, 5:
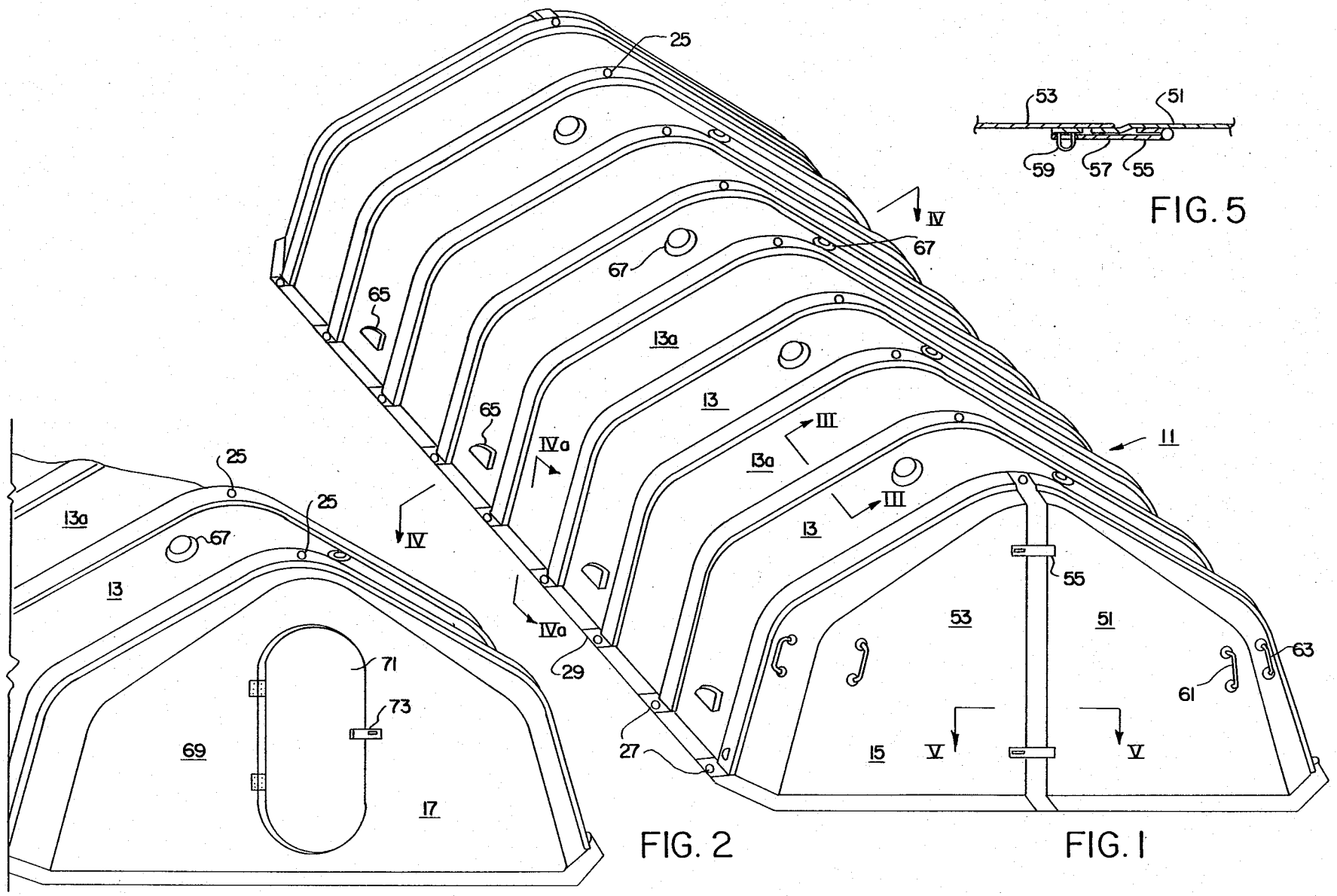
FIG. 1 is a schematic perspective view of a protective structure in the form of a boat shed in accordance with a preferred embodiment of the invention showing one end thereof.
FIG. 2 is a schematic view of the other end of the structure of FIG. 1.
FIG. 5 is a view along line V—V of FIG. 1.

Referring to the drawing and, more particularly, to FIG. 1, a protective structure of boat shed 11 in accordance with a preferred embodiment of the present invention comprises a plurality of sections 13, a front end closure 15 and a rear end closure 17.

Figures 3, 4, 4A:
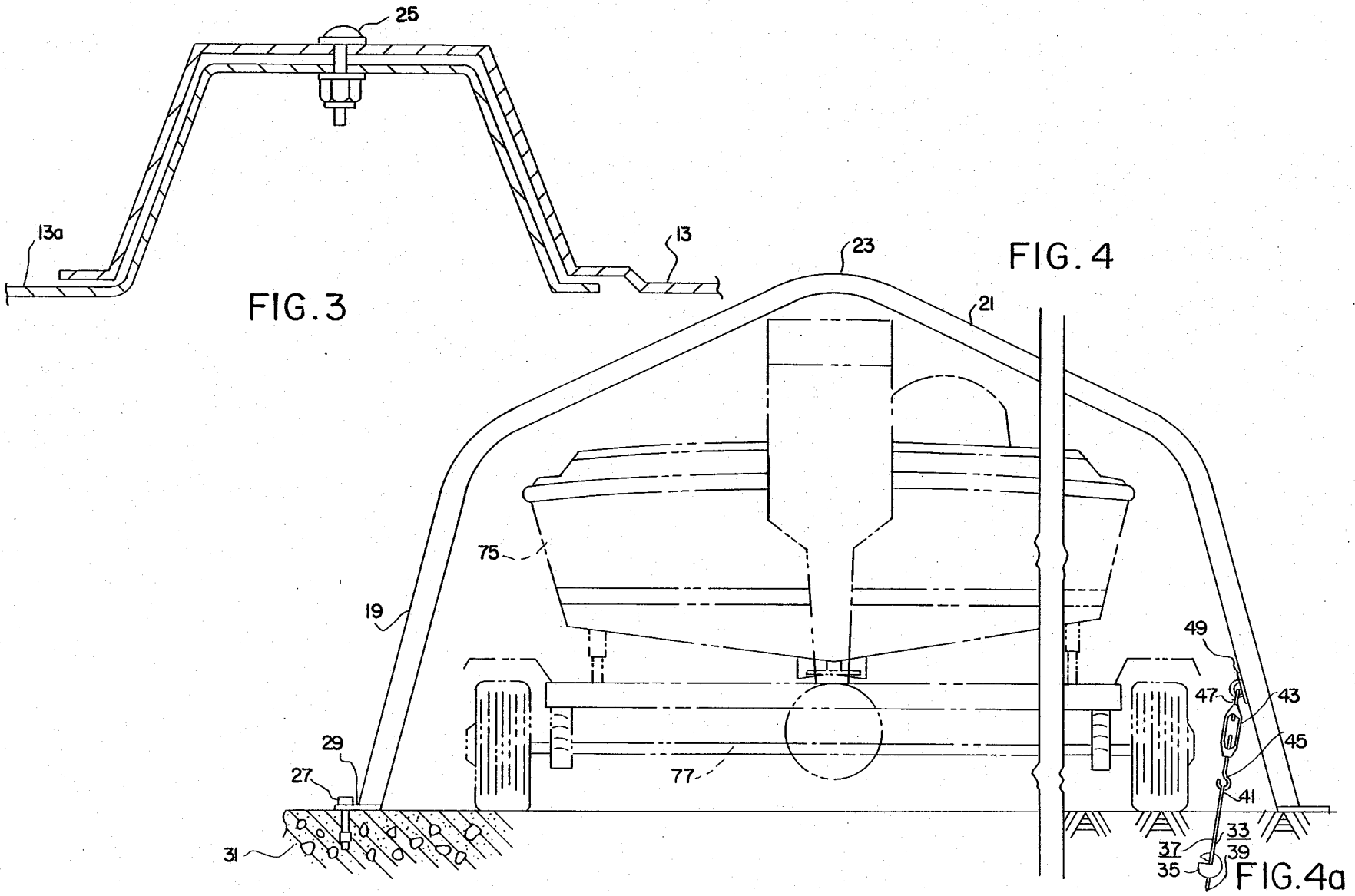
FIG. 3 is a sectional view along line III—III of FIG. 1.
FIG. 4 is a sectional view along line IV—IV of FIG. 1.
FIG. 4*a* is a cross-sectional view along line IVa—IVa of FIG. 1.

Each individual section 13 has a cross-sectional shape about as shown in FIG. 4 with upwardly sloping sides 19 that merge with a sloping roof portion 21 that merges in an arcuate ridge 23.

Referring to FIG. 3, one section 13, in cross-section, has a trapezoidal shape that overlaps a trapezoidal shape of an adjacent section 13*a*. A bolt, nut and washer assembly 25 fastens the section 13 to the section 13*a*. This type of fastening is typical, and it is to be noted that the several overlapping sections 13,13*a* are easily disassembled by removing the bolt, nut and washer fastener assemblies 25.

Referring to FIG. 4, one type of ground fastener is shown that comprises a bolt 27 that is fitted through a hole (not shown) in a projecting plate 29 at the bottom of the sloping side 19, the bolt 27 extends into the ground or a concrete or other kind of base 31.

FIG. 4*a* illustrates a modified form of ground fastener 33 for anchoring the structure 11 to a suitable support surface, typically the ground 31. The fastener 33 comprises a helix of a screw 35 fixedly mounted to a rod 37 having a sharply pointed one end 39, and an eye 41 at the other end. A conventional turnbuckle 43 having a hook 45 on one end coacts with the eye 41 of the rod 37, and the other end includes a hook 47 that engages a hole in a plate 49 mounted to the sloping wall 19 of the structural section 13*a*.

Referring again to FIG. 1, the front end closure 15 comprises two portions 51,53 which are slightly bowed, and which coact with a first section 13 of the structure 11. The portion 51 overlaps the portion 53 and a conventional hasp 55 is shown providing means for padlocking the front end closure 15. A pair of hasps 55 are shown, and each one includes a strap 57 that is hinged to the portion 51 and that coacts with an eye 59 mounted to the portion 53. The eye 59 can receive a padlock (not shown) in the usual manner.

In order to facilitate removing and installing the end closure portions 51,53, each portion is provided with a pair of handles 61,63 mounted to a respective end portion 51,53.

Each structural section 13 is provided with ventilating openings; vent openings 65 are disposed a short distance above the ground or base level; and vent openings 67 are located near the arcuate ridge 23.

Referring to FIG. 2, the rear end closure 17 comprises a single portion 69 slightly arcuate in cross-section that is provided with an entrance and exit hinged door 71 of conventional construction; such door 71 having a hasp 73 that can accommodate a padlock to prevent entry into the assembled structure 11.

FIG. 4 illustrates in a cross-section of the structure having the form of a boat shed 11 showing a motorboat 75 with outboard motor attached, carried on a trailer 77 disposed within the boat shed 11. Those persons who are skilled in the art will recognize that many other types and kinds of water craft can be stored in the boat shed 11 of the present invention. Some such other water craft are bass boats, Boston whalers, ski boats, racing hydroplanes, to name a few.

Those skilled in the art will recognize that the individual sections of the structure may be made of many kinds of materials such as plywood and aluminum, a preferred embodiment of the present invention has sections made of FIBERGLAS. Each section also has an interior coating of a suitable plastic applied in any manner, but usually by spraying it to the inner surface of the section.

From the foregoing description and the drawing showing a preferred embodiment of the present invention, those skilled in the art will recognize many features and advantages of the present invention among which the following are particularly pertinent, that:

The structure can be fabricated from any number of sections; each section being about three feet and four inches long. Since at least two sections are required to make the smallest boat shed, its minimum length inside will be six feet;

The structure will then have lengths of nine feet four inches; twelve feet eight inches and so forth;

The structure is not restricted to the protection of only marine craft, since it can be adapted easily to afford temporary protection for cable splicing operations, pipeline welding, electrical or ground field repairs and the like;

The several sections inter-react to form a watertight enclosure structure and, if desired, the ridge fasteners may be omitted, whereby the structure is more easily assembled and disassembled;

The structure can be raised up and set on a U-shaped wall-type enclosure, open at one end to accommodate taller vehicles, such as vans, campers, small trucks, and the like;

The structure, without end closures can serve as a car or boat port; and

The several sections are stackable so that all of the sections of an entire structure can be transported on a small truck or trailer from place to place.

Having thusly described and illustrated a preferred embodiment of the present invention, modifications thereof may be apparent to those skilled in the art that are within the scope of what I claim as new defined as:

I claim:

1. A protective structure comprising a plurality of interengaging sections, each section having a pair of spaced and parallel edges, each one of said sections having a trapezoidal male portion on one edge and a female portion on the opposite edge, said male portion of one section engaging and overlapping the female portion of an adjacent section on one edge and said female portion of one section engaging and overlapping a male portion of an adjacent section on the opposite edge; means for removably securing one section to another adjacent section on an opposite edge thereof; means for arranging a plurality of such interengaging sections in alignment with each other and seriatim to form an elongate protective structure; said protective structure having two ends, means for closing one end of said protective structure; means for closing the other end of said protective structure; first access means in one end closure; means for locking said first access means; second access means in said other end closure; means for locking said second access means; and means for fastening said protective structure to a base comprising a turnbuckle having on one end means engaging a side of said structure and having on the other end means engaging a rod, said rod having a portion of a helical surface at one end which portion is embedded into said base.

2. The protective structure of claim 1 wherein said access means is a door having means for locking said door.

3. The protective structure of claim 1 wherein said one end closure comprises two coacting half end closure portions with means for securing said end closure and preventing entry therethrough into said structure.

4. The protective structure of claim 3 including a pair of handles on each half end closures.

5. The protective structure of claim 1 wherein said means for fastening includes bolts securing said sections to said base.

6. The protective structure of claim 1 including means for ventilating the interior of said protective structure.

7. The protective structure of claim 1 wherein the means for securing adjacent sections together include bolt and nut assemblies.

* * * * *